US006715257B2

(12) United States Patent
Kent et al.

(10) Patent No.: US 6,715,257 B2
(45) Date of Patent: Apr. 6, 2004

(54) CONSTRUCTION MEMBER

(75) Inventors: Michael L. Kent, North Bay (CA); Andrew G. Forsayeth, Sundridge (CA)

(73) Assignee: Kent Trusses, Sundridge (CA)

( * ) Notice: Subject to any disclaimer, the term of this patent is extended or adjusted under 35 U.S.C. 154(b) by 0 days.

(21) Appl. No.: 09/971,009

(22) Filed: Oct. 5, 2001

(65) Prior Publication Data

US 2002/0040560 A1 Apr. 11, 2002

Related U.S. Application Data

(60) Provisional application No. 60/238,021, filed on Oct. 6, 2000.

(51) Int. Cl.[7] ..... E04C 3/30

(52) U.S. Cl. ..... 52/729.4; 52/690; 52/693; 52/650.2; 403/408.1; 428/36.5; 254/104

(58) Field of Search ..... 52/729.1, 729.2, 52/729.4, 690, 648.1, 650.2, 693, 730.7, 737.3; 403/408.1; 428/36.5; 254/104

(56) References Cited

U.S. PATENT DOCUMENTS

| | | | | | |
|---|---|---|---|---|---|
| 1,045,984 | A | * | 12/1912 | King | 254/104 |
| 1,911,413 | A | * | 5/1933 | Wait | 52/729.1 |
| 2,819,037 | A | * | 1/1958 | Wilkin | 254/104 |
| 3,836,118 | A | * | 9/1974 | Meyer | 254/104 |
| 3,960,637 | A | * | 6/1976 | Ostrow | 52/729.1 |
| 4,135,335 | A | * | 1/1979 | Jensen | 254/104 |
| 4,241,557 | A | | 12/1980 | Jensen | |
| 4,366,659 | A | | 1/1983 | Jensen | |
| 4,464,885 | A | | 8/1984 | Palacio | |
| 4,541,218 | A | | 9/1985 | Gottlieb | |
| 4,863,189 | A | | 9/1989 | Lindsay | |
| 4,947,612 | A | * | 8/1990 | Taylor et al. | 52/681.1 |
| 4,967,534 | A | * | 11/1990 | Lines | 52/729.1 |
| 5,261,425 | A | * | 11/1993 | Raker et al. | 52/729.1 |
| 6,018,921 | A | | 2/2000 | Lindsay | |
| 6,412,245 | B1 | * | 7/2002 | Lane et al. | 52/586.1 |
| 2003/0014938 | A1 | * | 1/2003 | Deschenes | 52/729.2 |

* cited by examiner

*Primary Examiner*—Carl D. Friedman
*Assistant Examiner*—Dennis L. Dorsey
(74) *Attorney, Agent, or Firm*—Dennison, Schultz & Dougherty

(57) ABSTRACT

An improved construction member or joist is disclosed that includes upper and lower chords connected by various members including first and second trimmable webs at either end thereof, which webs include end portions received in grooves in the upper and lower chords. Significantly, the profile of the end portions of the webs includes at least one notch or ridge that fits within a corresponding notch or ridge in the chord to provide a more secure attachment, even under unusual loading conditions. Supplemental webs are also provided that can be attached to the member at various locations to provide an additional degree of support only where needed.

12 Claims, 3 Drawing Sheets

CONSTRUCTION MEMBER

This application claims the benefit of U.S. provisional patent application Ser. No. 60/238,021 filed Oct. 6, 2000.

FIELD OF THE INVENTION

The present invention is directed toward an improved construction member, and more specifically, toward a construction member such as a joist adapted to withstand stresses applied in several different directions as occur when the joist is used in a modular home being transported on a trailer.

BACKGROUND OF THE INVENTION

Joists and other construction members made of natural dimensional wood are becoming increasingly expensive and hard to obtain because the old growth wood of large diameter and high strength used for such members is itself becoming rare and expensive. Second growth lumber is not an acceptable substitute because of its limited size and strength. However it is desirable that second growth lumber be used whenever possible to minimize the use of larger, solid natural wood members.

The use of engineered construction members such as joists has increased in recent years to take advantage of the lower cost of second growth lumber. Such joists generally comprise upper and lower chords formed from second growth lumber or laminated veneer lumber connected by one of several means. One such joist uses a solid and continuous plywood or oriented strand board (OSB) web member running the length of the chords. Since OSB can be produced from wood that is unsuitable for many other structural uses, the lower cost of the materials used offsets much of the additional cost associated with manufacturing the member. Another type of engineered joist uses dimensional lumber chords joined by a combination of metal webs and vertical lumber webs attached to the top and bottom chords with metal plates. Still another uses wood struts attached between the upper and lower chords, some normal to the chords and others angled with respect thereto. These member may be finger jointed and glued to the top and bottom chords, for example.

Another advantage of engineered products over dimensional lumber is that these products can readily be made to any size and configuration required by industry, and can be made in a consistent manner so that they are uniformly straight and lightweight. It is also easier to control the strength and other properties of engineered lumber than natural lumber, and this allows manufacturers to provide products of consistent quality that are in high demand. The many through-openings between the upper and lower chords also makes the installation of wiring and plumbing in a structure much easier when engineered joists are used because the drilling required when dimensional lumber is used is reduced or eliminated. Engineered members are less expensive to install than dimensional lumber and can even be designed to provide specific load-bearing characteristics when necessary. And, when the ends of such construction members are provided with trimmable web sections between the upper and lower chords, these member can easily be trimmed at a work site to the exact dimensions needed, just like natural wood products.

While such engineered joist perform admirably, there are still problems that remain to be addressed. For example, when webs are added to the ends of such members to make them trimmable, it is generally necessary to glue the web to the upper and lower chords of the construction member and clamp the member while it dries. If the member is not clamped, the upper and lower chords may spread or the distance therebetween may not be consistent. Clamping adds to the time and cost required to make such a construction member.

Furthermore, certain applications require the joists to withstand forces that are applied in different directions or forces that are not applied uniformly along the length of the joist. One example of such problems is found in the engineered joists used to support a manufactured or "mobile" home. Such homes are generally constructed in one or two large sections and then transported by tractor trailer to a home site at which point they are placed on a fixed foundation. The modular homes are generally rectangular so that they will fit on a trailer. The joists that support the structure generally run the width of the home, which direction corresponds to the width direction of the trailer. However, joists are normally designed to be supported near their ends, such as when the home is placed on a foundation. On the trailer, however, the support comes at locations closer to the middle of the width of the structure. Supported in this manner, the joists and the manufactured homes are subject to flexure during the moving process, and this can lead to cracked interior walls and other problems when the home is transported. One method to address this problem would be to use over-manufactured joists that could withstand such stresses—however, as these stresses occur only for several hours of the many-year life span of a home, this method unnecessarily increases costs. It would therefore be desirable to provide an engineered joist that can be assembled without clamping, that provides additional support only in certain locations, and that resists the twisting and other unusual forces experienced by joists used in a manufactured home when the home is being transported.

SUMMARY OF THE INVENTION

These and other problems are addressed by the present invention which comprises an engineered construction member or joist comprising, in a first embodiment, top and bottom chords connected by a web, which web has non-linear, profiled end portions that are received in correspondingly shaped profiled grooves in the chords. Because these profiled end portions provide a mechanical connection between the chords and web, the need to clamp the upper and lower chords together when the web is glued to the chords is reduced or eliminated. It has also been found that these profiled end portions seem to provide greater strength and rigidity to the joists, especially when forces are applied in different directions when the joist and structure in which it is incorporated, is moved. While a primary use for such joists is envisioned to be in the manufactured home market, other applications where joist are subject to a forces in a variety of different directions can readily be imagined.

In a second embodiment of the invention, a joist is provided with a two-piece web member that can be inserted at any needed location along the joist to provide additional support between the chords at the locations where a large load is to be supported. Advantageously, these web members can either be installed when the joist is manufactured or alternately, in the field when a structure incorporating the joist is being attached to another structure. For example, the web element can be placed where needed to provide additional support during the transport of a manufactured home, removed at the job site, and replaced with a second element at a different location along its length, such as under a load supporting wall, where needed. Since the web element is easy to install and remove, the element used during transport can be removed at the job site so as not to interfere with the placement of wiring and plumbing, etc. in the finished structure. And, when the vertical supports that surround the center chase of a joist are replaced with web members, it becomes possible to provide wider chases than has heretofore been feasible without unduly weakening the construction member.

It is therefore a primary object of the present invention to provide an improved constructional member with increased rigidity.

It is another object of the invention to provide an improved constructional member having chords connected by webs which are attached to the chords at profiled end portions.

It is yet another object of the invention to provide a construction member than can be assembled without clamping.

It is a further object of the invention to provide selectively insertable support webs for an engineered joist.

It is still another object of the invention to provide a method of selectively reinforcing a joist at a given location along its length.

It is still a further object of the invention to provide an engineered joist having a larger than normal central or other chases.

It is yet another object of the invention to provide an engineered joist with trimmable ends which include web portions with profiled end portions routed into upper and lower chords.

BRIEF DESCRIPTION OF THE DRAWINGS

These and other objects of the invention will become clear from a reading of the detailed description of the invention together with the following drawings of which.

DETAILED DESCRIPTION OF THE INVENTION

Figure 1:
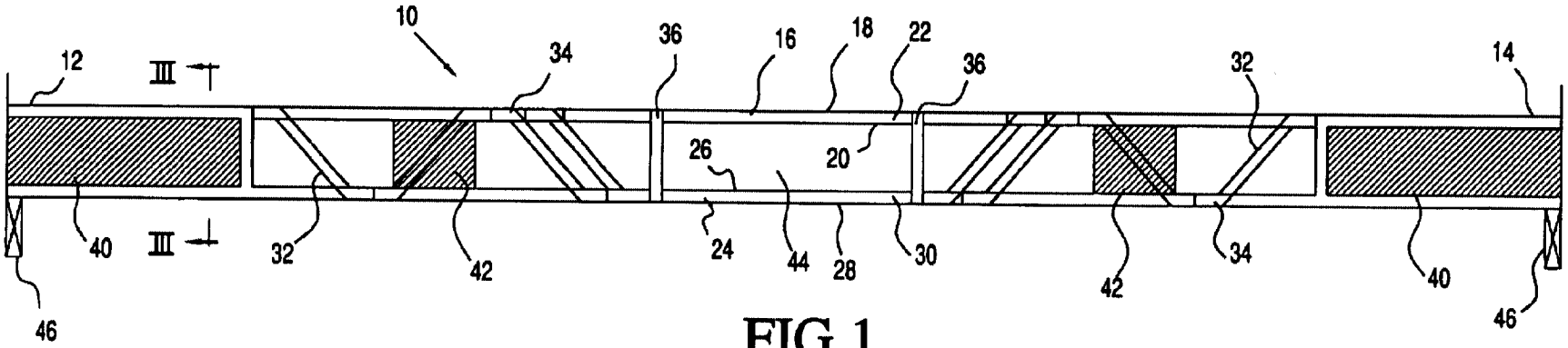
FIG. 1 is a front elevational view of an improved joist according to the present invention being supported at its ends.

Referring now to the drawings, wherein the showings are for purposes of illustrating preferred embodiments of the invention only, and not for the purpose of limiting same, FIG. 1 shows a construction member or joist 10 having a first end 12 and a second end 14 formed from an upper chord 16 having a top edge 18, a bottom edge 20 and first and second side edges 22 and a lower chord 24 having a top edge 26, a bottom edge 28 and first and second side edges 30. The use of directional terms herein such as "top" and "bottom" refer to members oriented like the joist of FIG. 1. Of course, these construction members do not have to be used as joists and can be inverted or used in a non-horizontal orientation; however, as such construction members are generally used in a vertical plane, they will be described in this orientation for simplicity. Upper chord 16 is connected to lower chord 24 by a plurality of angled braces 32 attached to the upper chord side edges 22 and lower chord 24 side edges 30 by metal plates 34 as known in the art, and one or more vertical braces 36. Various arrangements of angled and vertical braces other than those shown in the figures are known in the prior art and can be used without departing from the scope of this invention. The joist also includes first and second end webs 40 which allow up to twenty four inches to be trimmed off the joist to provide a joist of a desired length, first and second supplemental webs 42, and a wide center chase 44.

Figure 2:
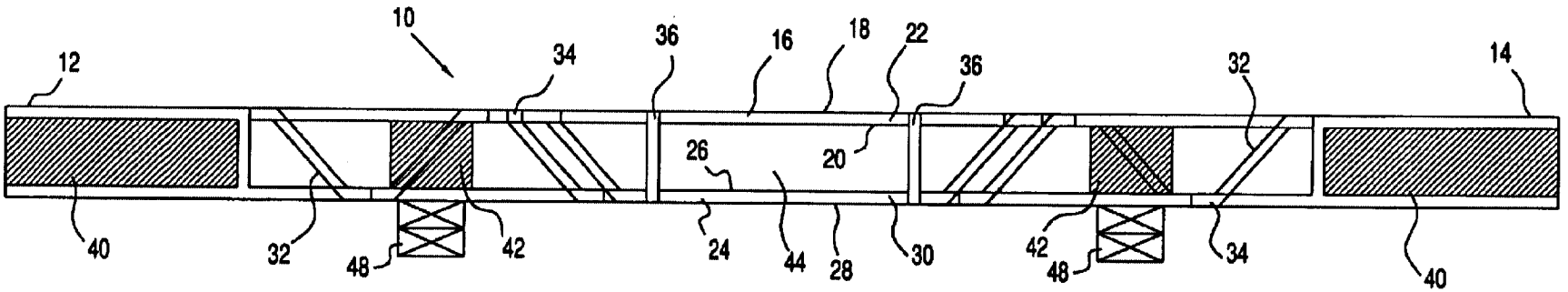
FIG. 2 is a front elevational view of the joist shown in FIG. 1 being supported at two points inward of its ends.

The joist shown in FIG. 1 is supported at its ends 12, 14 by supports 46. When the joist 10 is used in a manufactured home, for example, supports 46 would be the block foundation that supports the home. In FIG. 2, joist 10 is shown supported at two points inwardly of its ends by supports 48. This configuration could occur in a variety of situation, including when the joist is used in the floor of a manufactured home that is being moved to a home site. In this case, supports 48 would be part of the trailer transporting the house.

Figure 3:
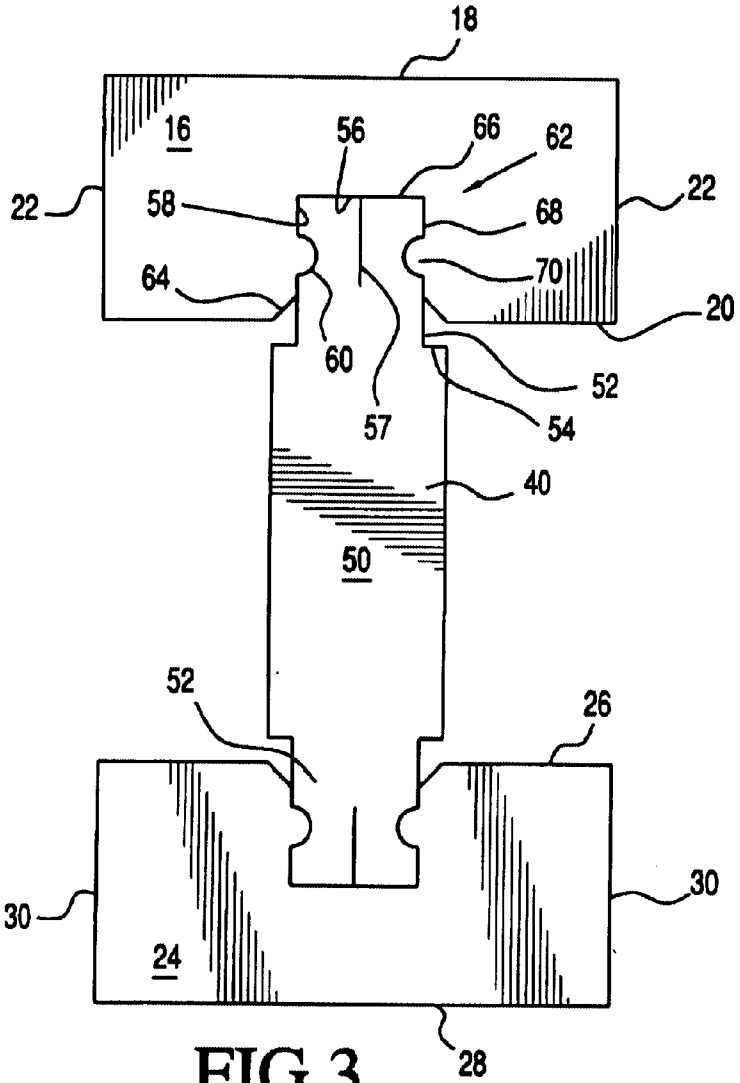
FIG. 3 is sectional elevational view taken through line III—III in FIG. 1.

Referring now to FIG. 3, the novel manner of mounting end webs 40 between the top and bottom chords is shown. Each of the ends webs 40 includes a central body portion 50 and first and second end portions 52 which extend from a shoulder 54 of the body portion. Each end portion 52 includes an end edge 56 having a cut 57 and connected to shoulder 54 by two side edges 58; each side edge 58 includes a notch 60. Upper chord 16 includes a groove 62 in bottom edge 20 into which first end portion 52 of end web 40 is received. Groove 62 has chamfered edges 64, an end wall 66 and two side walls 68 each of which includes a ridge 70 shaped and positioned to be received in notch 60 when the web is in place between the two chords. Cut 57 allows the end portion 52 to compress somewhat when it is inserted into groove 62.

When the web 40 is in place, shoulder 54 is spaced apart from chamfered edges 64; when an adhesive is used to bond the web to the chords, some will leak from groove 62; this gap receives the adhesive that leaks out and when that adhesive bonds between the edges 64 and shoulder 54 a stronger, more flexible bond results. The excess glue that surrounds the joint also helps provide a watertight seal and prevents water from leaking into the joint. The second end portion 52 of the end web 40 is identical to the first end and will not be described separately. This arrangement provides a more secure connection between the web and the chords, even when stresses are applied to the joist in various unusual directions, such as the sideways and other forces that such a joist might experience when used in a modular home being transported.

Figure 7:
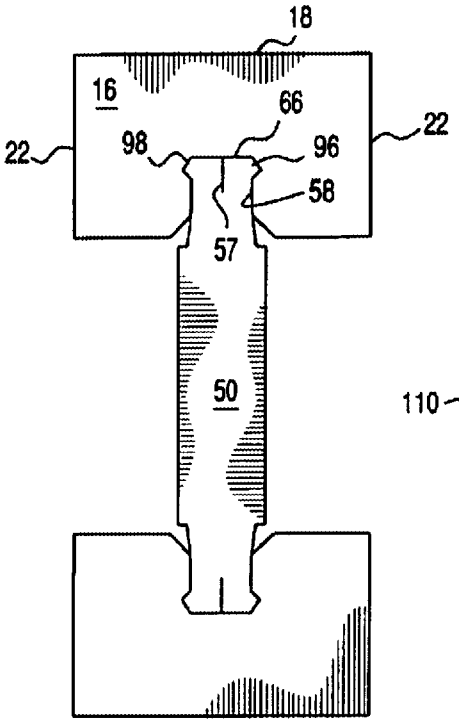
FIG. 7 is a sectional elevational view of a second alternate embodiment of a joist according to the present invention; and, FIG. 8 is a side elevational view of a joist according to the present invention showing a modification that can be accommodated by such a joist.
Figure 6:
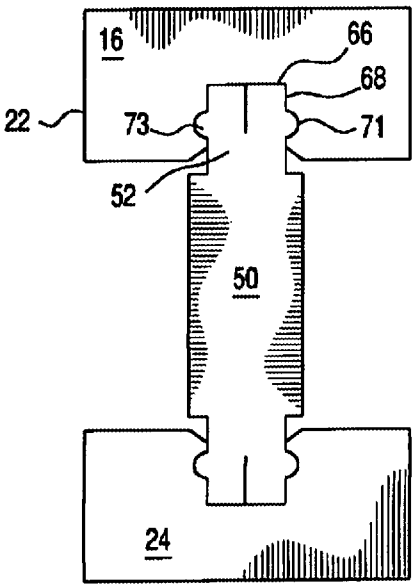
FIG. 6 is a sectional elevational view of a first alternate embodiment of a joist according to the present invention.

FIG. 6 shows an alternate embodiment of the end portion 50 wherein the web includes a ridge 73 while the groove sidewall 68 includes a notch 71 that receives the ridge. FIG. 7 shows yet another embodiment of the end portion 52 wherein protrusions 96 are provided near the end edge 56 in channels 98 of the end webs 40 and the side edges 58 are somewhat angled. This arrangement provides benefits similar to those discussed above, and, in addition, may make end portion easier to insert into groove 62. Of course other arrangements of protrusions and openings, or multiple notches and ridges, could also be used without departing from the scope of this invention.

Figure 8:
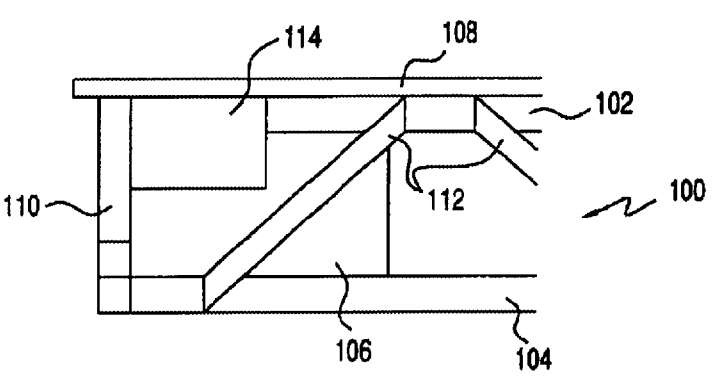

FIG. 8 shows a use of a construction member according to the present invention that takes advantage of the increased strength and rigidity provided by the profiled end edges of the end web members described above. FIG. 8 shows a construction member 100 used as a joist, which construction member includes a top chord 102, a bottom chord 104 and an end web 106 installed below a floor 108. A vertical end support 110 is attached to bottom chord 104 and to floor 108; diagonal supports 112 are also used between the upper and lower chords, one of which is installed adjacent to end web 106. This arrangement provides sufficient strength that the end of top chord 102 can be removed and an opening 114 provided in the end web to allow wires or conduits to be installed near the end of a construction member. Furthermore, this open-top arrangement allows pipes or conduits to be dropped into opening 114 from above, before floor 108 is installed, thus greatly simplifying the installation process. Prior art construction members generally did not provide adequate strength to function properly with part of the top chord removed.

Figure 4:
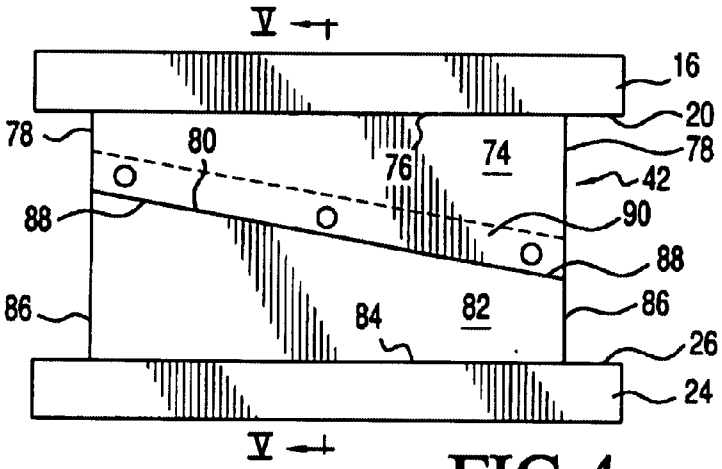
FIG. 4 is a detail view of one of the supplemental joist supports shown in FIG. 1.
Figure 5:
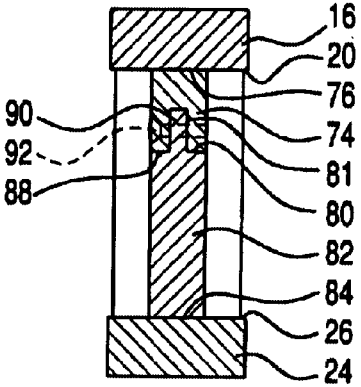
FIG. 5 is a sectional elevational view taken along line V—V in FIG. 4.

As seen in FIGS. 4 and 5, each supplemental web 42 comprises a first or upper portion 74 having a top edge 76 adjacent bottom edge 20 of upper chord 16, first and second side edges 78 extending away from the upper chord, and a bottom edge 80 angled with respect to top edge 76 to give upper portion 74 the shape of a trapezoid. Bottom edge 80 of upper portion 74 also includes a channel 81 running between the side edges 78. Supplemental web 42 further comprises a bottom portion 82 having a bottom edge 84 lying adjacent the top edge 26 of lower chord 24, first and second side edges 86 extending away from the bottom chord, and a top edge 88 angled with respect to bottom edge 84 to give the lower portion 82 a trapezoidal shape. Top edge 88 includes a projecting tongue 90 extending between first and second side edges 86 which is shaped to be slidingly received by channel 81 of upper portion 74. Upper portion 74 and lower portion 82 are connected by adhesive and/or screws 92 as will be described in more detail herein.

As will be appreciated from the foregoing description, one or more supplemental supports 42 can be placed at substantially any location along the joist between the end webs 40 by placing bottom portion 82 on the lower chord 24 and sliding upper portion 74 along upper chord 16 and against bottom portion 82 so that tongue 90 of the upper portion is received in channel 81 of the lower portion. As the two portions are forced against one another, angled bottom edge 80 of the upper portion and angled top edge 88 of the bottom portion slide against one another and force the top edge 76 of the upper portion against the upper chord and the bottom edge 84 of the lower portion against the lower chord 24. An adhesive may be used to hold the two portions together and/or screws 92 can be driven thought the sides of the portions and through tongue 90 to hold the portions together. Thus, the supports may be placed as shown in FIG. 2 when the joists form the bottom of a manufactured home to provide additional support of the home on the bed of a trailer. These joists may be removed at the installation site if the additional support is no longer needed. Alternately, one or more of the supplemental support can be placed where extra support is needed—beneath a load-bearing wall, for example. Because the supplemental supports are easily installable on-site, they can be placed only where needed, leaving a maximum amount of room free for the running of wires, conduits, etc. and keeping the weight of the member to a minimum. And, because of the substantially increased support provided by such elements, the width of center chase 44 (or other chases) can be greater than is usually possible with conventional engineered lumber when the supplemental supports are placed adjacent the center opening.

The foregoing invention has been described in terms of preferred embodiments only. Obvious additions and modifications will occur to those skilled in the arts upon a reading and understanding of foregoing disclosure, and it is intended that all such obvious changes form part of this application to the extent that they are included within the scope of the several claims appended hereto.

We claim:

1. A joist comprising:

a first chord;

a second chord spaced apart from said first chord;

at least one supplemental web comprising a first member having a first side engaging said first chord and a slant side angled with respect to said first side, a second member having a first side engaging said second chord and a slant side angled with respect to said second side, wherein said first member slant side is connected to said second member slant side; and, at least one end web having a first end connected to said first chord and a second end mechanically interlocked with said second chord.

2. The joist of claim 1 wherein said at least one end web is trimmable.

3. The joist of claim 1 wherein said second end is embedded in said second chord.

4. The joist of claim 3 wherein said first end is embedded in and mechanically interlocked with said first chord.

5. The joist of claim 1 wherein said second chord has a length and a longitudinally extending groove, said groove having a sidewall with at least one longitudinally extending ridge wherein said spacing member has a length and a said second end includes a longitudinally extending notch in which said ridge is received.

6. The joist of claim 5 wherein said groove has a groove width and a mouth, the width of said mouth being greater than said groove width.

7. The joist of claim 1 wherein said at least one end web comprises a central portion having a first width and wherein said second end has a width less than said central portion width.

8. The joist of claim 1 wherein said first slant side is parallel to said second slant side.

9. The joist of claim 1 further comprising a mechanical fastener for securing said first member to said second member.

10. The joist of claim 1 wherein said first member includes a groove and said second member includes a tongue received in said groove.

11. The joist of claim 10 wherein said first member and said second member comprise oriented strand board.

12. A method of reinforcing a construction member having first and second generally parallel chords at a given location comprising the steps of:

providing a first member having a first side and a slant side angled with respect to said first side, providing a second member having a first side and a slant side angled with respect to said second side, placing said first member first side against said first chord, placing said second member first side against said second chord, moving said first member toward said second member until said first member slant side engages said second member slant side, providing at least one end web having a first end and a second end mechanically interlocking said at least one end web first end with said first chord and said at least one end web second end with said second chord.

* * * * *